US005161734A

United States Patent [19]

Ruehl et al.

[11] Patent Number: 5,161,734

[45] Date of Patent: Nov. 10, 1992

[54] RECLOSABLE CARTON FOR GRANULAR MATERIALS

[75] Inventors: Dennis J. Ruehl, Cincinnati, Ohio; Charles L. Gunn, Lawrenceburg, Ind.; James L. Stone, Grand Rapids, Mich.

[73] Assignee: Procter & Gamble, Cincinnati, Ohio

[21] Appl. No.: 698,413

[22] Filed: May 10, 1991

[51] Int. Cl.[5] ..... B65D 5/54

[52] U.S. Cl. ..... 229/227; 229/147; 229/223

[58] Field of Search ..... 206/607, 621, 624, 628; 229/147, 154, 210, 221, 223, 224, 227

[56] References Cited

U.S. PATENT DOCUMENTS

| | | | |
|---|---|---|---|
| 2,369,387 | 2/1945 | Williamson et al. | 229/147 |
| 2,403,698 | 7/1946 | Williamson et al. | 229/147 |
| 3,140,809 | 7/1964 | Hickin et al. | 229/154 |
| 4,102,457 | 8/1978 | Meyers | 206/624 |
| 4,141,449 | 2/1979 | Stone | 206/621 |
| 4,284,193 | 8/1981 | Roccaforte | 229/147 |
| 4,314,643 | 2/1982 | Forbes, Jr. | 206/621 |
| 4,542,847 | 9/1985 | Lindstrom | 229/147 |
| 4,679,694 | 7/1987 | Donohie et al. | 229/154 |
| 4,688,677 | 8/1987 | Roccaforte | 206/624 |
| 4,768,703 | 9/1988 | Sosler et al. | 229/123.1 |
| 4,986,420 | 1/1991 | Gunn et al. | 229/117.22 |

*Primary Examiner*—Stephen Marcus
*Assistant Examiner*—Christopher McDonald
*Attorney, Agent, or Firm*—E. Kelly Linman; Thomas H. O'Flaherty

[57] ABSTRACT

A sift-resistant, reclosable carton for granular or powdered materials. The carton is a six-sided enclosure including opposed top and bottom walls, opposing front and back walls, and opposing end walls. Each end wall is comprised of an inner layer having a top edge abutting the top wall and an outer layer. The outer layer has a horizontal tear strip thereacross. The front wall has an inner layer having a top edge abutting the top wall and an outer layer. The outer layer has a horizontal tear strip thereacross which is integral with the tear strips of the end walls, forming one continuous tear strip. A glue flap is integrally attached to the top edge of the inner layer of the front wall along substantially its full length. The glue flap has a distal attachment portion and a proximal locking portion. The two portions are joined along a full length line of weakness. The distal attachment portion is secured to the inner surface of the outer layer of the front wall above the tear strip.

8 Claims, 10 Drawing Sheets

RECLOSABLE CARTON FOR GRANULAR MATERIALS

FIELD OF THE INVENTION

The present invention relates to carton board cartons, and more particularly, to such cartons suitable for housing granular or powdered materials that are reclosable and sift-resistant.

BACKGROUND INFORMATION

Reclosable carton board cartons have been available for many years. The ability to repeatedly open and close/lock down these cartons after initial opening have long been important goals of those skilled in the art. One way to accomplish these goals is to use a carton which can be opened and closed by the use of locking flaps. Examples of these cartons are found in various U.S. patents.

One patent of particular interest is U.S. Pat. No. 4,326,634 which issued to Meyers on Apr. 27, 1982. This Patent discloses a reclosable carton. A locking flap attached to the front wall of the carton engages with the inner layer of the front skirt panel enabling the carton to be repeatedly closed or locked down after initial opening.

Existing cartons of this type, however, suffer from at least one major drawback when used with granular or powdered materials. They are not sift-resistant. Therefore, spillage often accompanies transporting and opening of the carton. During transit, the granules migrate into the spaces between the various layers and through any cracks and crevices. For example, the granules have a way of working themselves between the inner layer which remains stationary and the outer layer which is moved during opening. Thus, when the outer layer is moved as the carton is opened the granules are left unsupported and fall. In addition, if the top and its adjacent skirt are allowed to float, as the skirt is not fixed to the carton walls during shipping, granules will sift over the front and side walls. The resulting mess that is created is unsatisfactory to consumers.

Accordingly, it is an object of the present invention to provide a granules carton that is both reclosable and sift-resistant;

It is further an object of the present invention to provide a granules carton that is easy to fill, open and dispense therefrom;

It is further an object of the present invention to provide a carton which substantially eliminates the problem of granular contents spilling upon opening;

It is further an object of the present invention to provide such a carton that is opened by the removal of a tear strip;

It is lastly an object of the present invention to provide a carton that accomplishes the aforementioned objectives at minimal costs.

SUMMARY OF THE INVENTION

In accordance with one aspect of the present invention a sift-resistant, reclosable carton is provided for granular or powdered materials. The carton is a six-sided enclosure having opposed top and bottom walls, opposing front and back walls, and opposing end walls. Each of the end walls has an inner layer with a top edge abutting the top wall and an outer layer. The outer layer has a horizontal tear strip thereacross. The front wall has an inner layer with a top edge abutting the top wall and an outer layer. The outer layer has a horizontal tear strip thereacross which is integral with the tear strips of the end walls to form one continuous tear strip. A glue flap is integrally attached to the top edge of the inner layer of the front wall along substantially its full length. The glue flap has a distal attachment portion and a proximal locking portion. The two portions are joined along a full length line of weakness. The distal attachment portion is secured to the inner surface of the outer layer of the front wall above the tear strip.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENT

Figure 1:
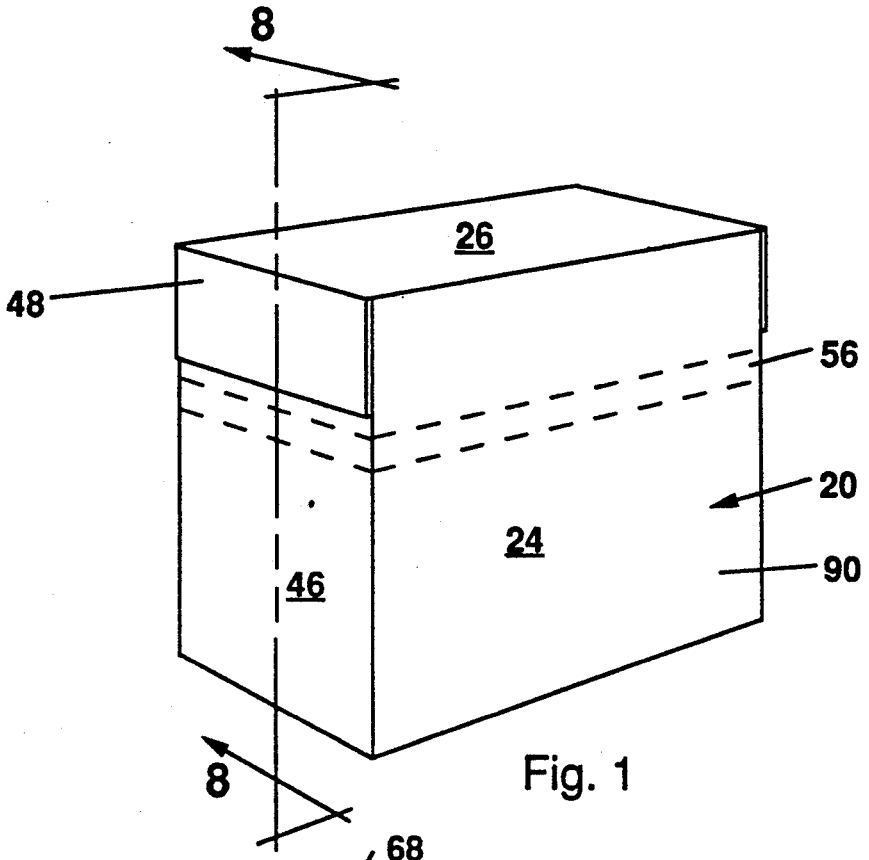
FIG. 1 is a perspective view of a preferred embodiment of the present invention, prior to opening.
Figure 2:
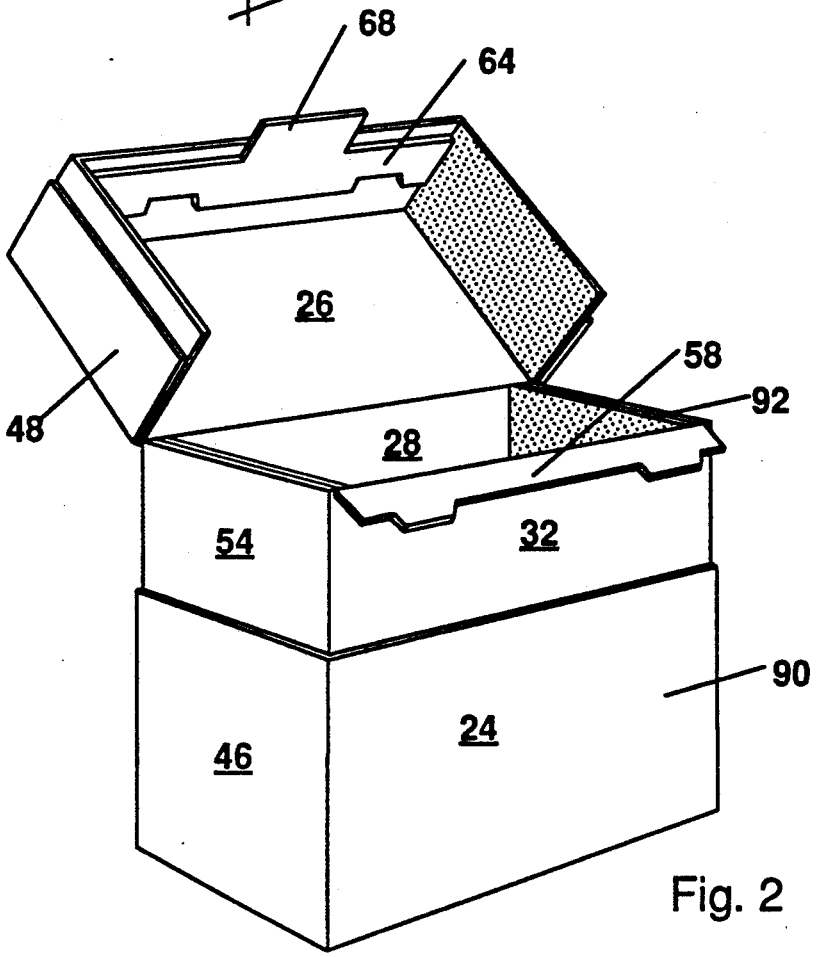
FIG. 2 is a perspective view of the carton of FIG. 1, seen in an open condition with the top raised.

In a particularly preferred embodiment seen in FIG. 1, the present invention provides a side-fill, sift-resistant, reclosable carton, indicated generally as 20, for housing granular or powdered materials. The embodiment of FIG. 1 is made from the blank illustrated in FIG. 3.

Figure 3:
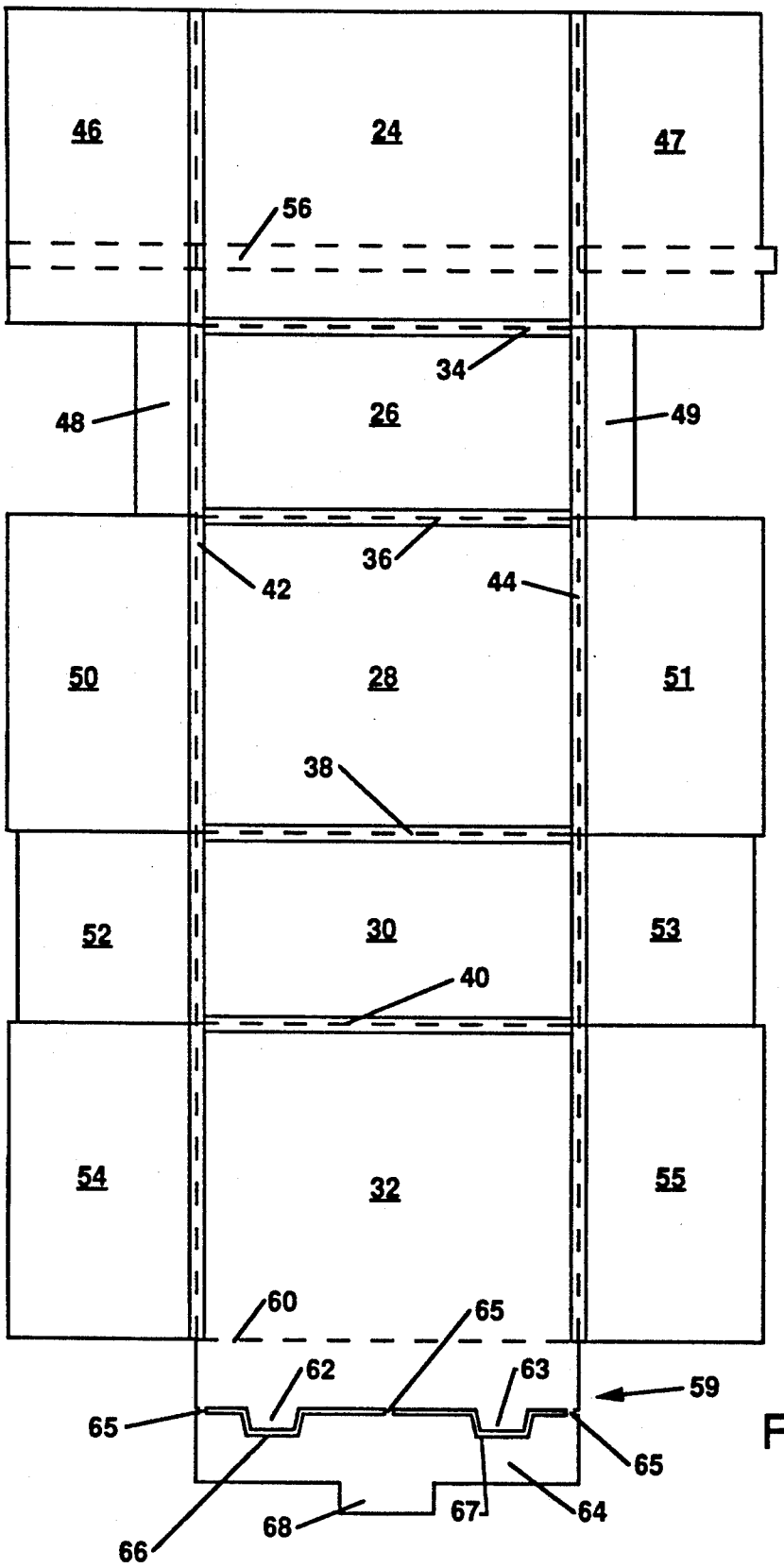
FIG. 3 is a top plan view of the blank used to make the carton of FIG. 1.

Referring to FIG. 3, the blank incorporates five main panels 24, 26, 28, 30 and 32 which are successively connected to each other along transverse score lines 34, 36, 38, and 40. The five main panels, from top to bottom, include a front outer panel 24, a top panel 26, a back panel 28, a bottom panel 30 and a front inner panel 32. The transverse boundaries of each of these panels 24, 26, 28, 30 and 32 are defined by axial score lines 42 and 44. The axial score lines 42 and 44 also serve to connect each panel 24, 26, 28, 30 and 32 to an end flap 46 through 55 at each transverse edge.

The end flaps associated with the front inner panel 32 and the back panel 28 are the major flaps 54, 55, and 50, 51. The major flaps 50, 51, 54 and 55 preferably have substantially the same transverse dimension as the axial dimension of the top panel 26; and even more preferably, have substantially the same overall dimensions as the resulting end wall of the carton 20. The end flaps associated with the bottom panel 30 are the minor flaps 52 and 53. The minor flaps 52 and 53 are somewhat smaller in transverse dimension than the major flaps 50, 51, 54 and 55. The end flaps associated with the top panel 26 will hereinafter be referred to as ears 48 and 49. The transverse dimension of the ears 48 and 49 is substantially smaller than the transverse dimension of the major flaps 50, 51, 54 and 55.

The end flaps associated with the front outer panel 24 will hereinafter be referred to as extension panels 46 and 47. In this embodiment these extension panels 46 and 47 have substantially the same transverse dimension as the major flaps 50, 51, 54 and 55. The front outer panel 24 and its associated extension panels 46 and 47 have a transverse tear strip 56 extending thereacross. Tear strip 56 is preferably two transverse parallel lines 50% cut into the outer side of the front outer panel 24 and extension panels 46 and 5 47. A 50% cut is a continuous cut which extends from the surface of the material down to a depth which is half of the thickness of the material. The 50% cut assures a clean tear at the surface which leaves a relatively pleasing appearance, particularly when the carton 20 is printed. Attached to the inner side of tear strip 56 is a reinforcing tape, not shown, which helps prevent the tear strip 56 from breaking into pieces as it is removed from the carton 20. One end of the tear strip 56 extends beyond the axial edge of the extension panel 47, providing a tab to facilitate grasping tear strip 56.

A glue flap 59 comprising proximal locking portion 58 and distal attachment portion 64 is connected to the lower transverse edge of the front inner panel 32 via a cut score line 60. The cut score line 60 is preferably cut deeply enough to facilitate bending of the proximal locking portion 58 about cut score line 60 but not so deep as to permit the proximal locking portion 58 to separate from front inner panel 32 during repeated normal opening of the carton 20. In addition, the cut score line 60, being a partial cut instead of a full cut, prevents the granular material from migrating through the cut.

Proximal locking portion 58 is connected to distal attachment portion 64 along a full length line of weakness which comprises remotely spaced land areas 65. A pair of tabs 62 and 63 are located along the lower transverse edge of the proximal locking portion 58 opposite a pair of matching cutouts 66 and 67 along the upper transverse edge of distal attachment portion 64. The engagement between tabs 62 and 63 and cutouts 66 and 67 in use permits the carton 20 to be repeatedly opened and locked down, as will be discussed hereinafter.

Distal attachment portion 64 comprises an opening tab 68 along its lower transverse edge. After tear strip 56 has been removed opening tab 68 will aid the user by providing a convenient means to open the carton 20, as will be discussed hereinafter.

Figure 4:
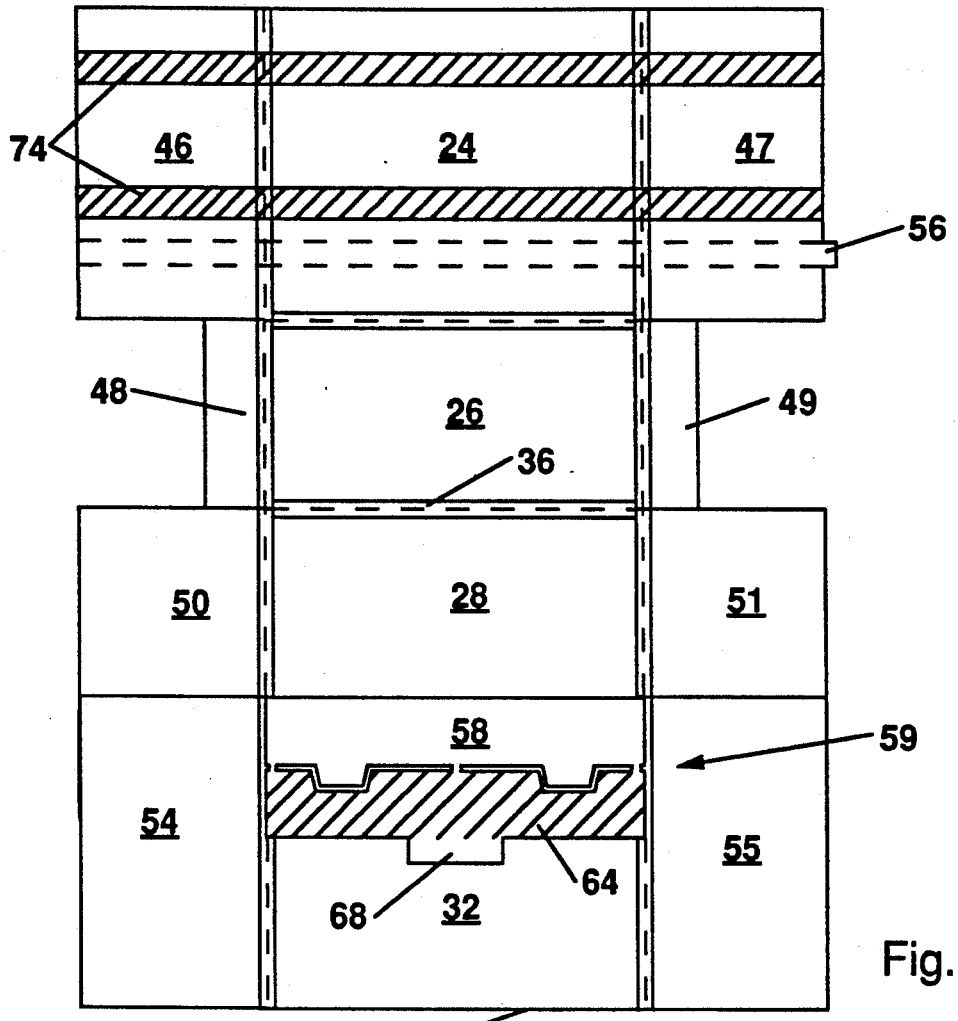
FIG. 4 is a top plan view of the blank of FIG. 3 after initial folding, showing the glue application areas.
Figure 5:
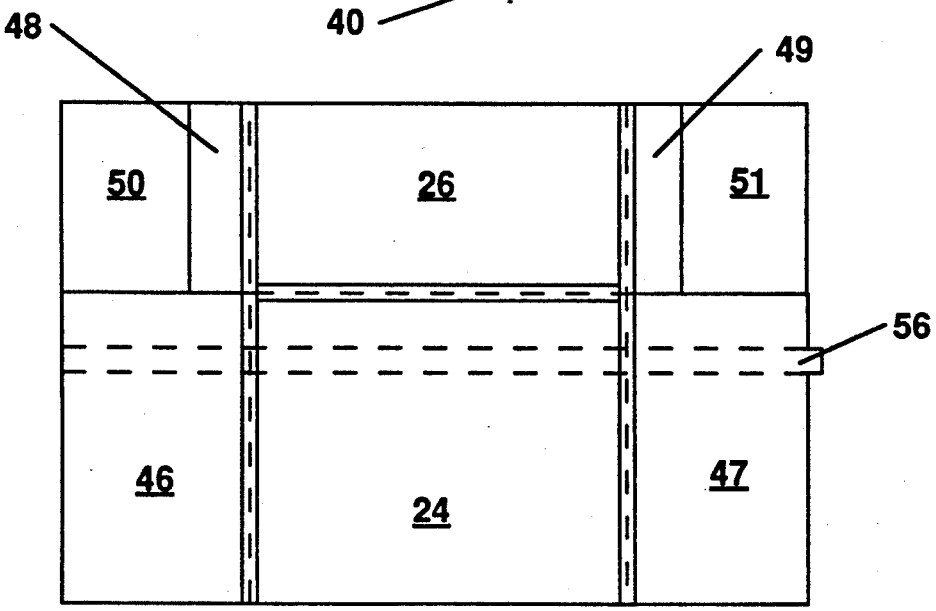
FIG. 5 is a top plan view of the flattened sleeve made from the blank of FIG. 3.

To assemble the carton 20 the blank of FIG. 3 is first folded and glued to form the sleeve shown in FIG. 5. Initially, glue flap 59 is folded downwardly as a unit 180 about the transverse cut score line 60 to lie against the outer side of front inner panel 32. Glue is then applied to distal attachment portion 64. Then the blank is folded 180° about the transverse score line 40 which separates the front inner panel 32 from the bottom panel 30 to place front inner panel 32 above bottom panel 30 and the lower portion of back panel 28. Glue is then applied to the front outer panel 24 in the two locations indicated as 74. The result of these steps is shown in FIG. 4. The blank is then folded 180° about the transverse score line 36 which separates the top panel 26 from the back panel 28 so that front outer panel 24 overlies glued flap 59 and inner panel 32. Thus, the distal attachment portion 64 of glue flap 59 is adhered to the inner side of the front outer panel 24 above tear strip 56. In addition, front outer panel 24 and extension panels 46 and 47 are adhered below the tear strip 56 to the front inner panel 32 and the major flaps 54 and 55 associated therewith. The finished sleeve is seen in FIG. 5.

Figure 6:
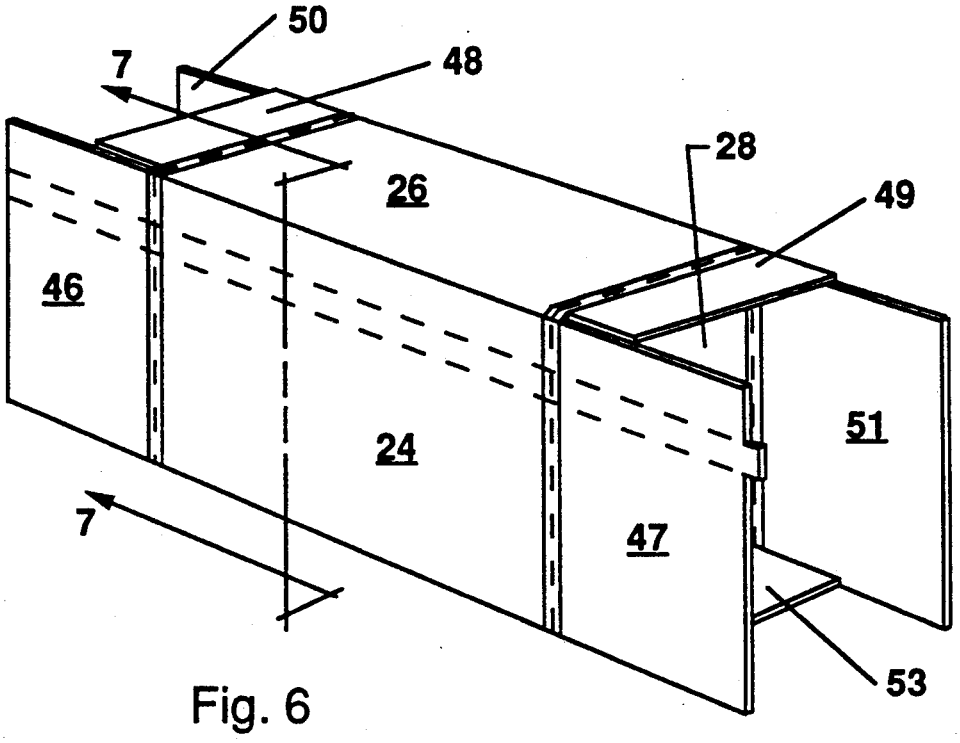
FIG. 6 is a perspective view of the sleeve of FIG. 5 after being squared for transformation into the carton of FIG. 1.
Figure 8:
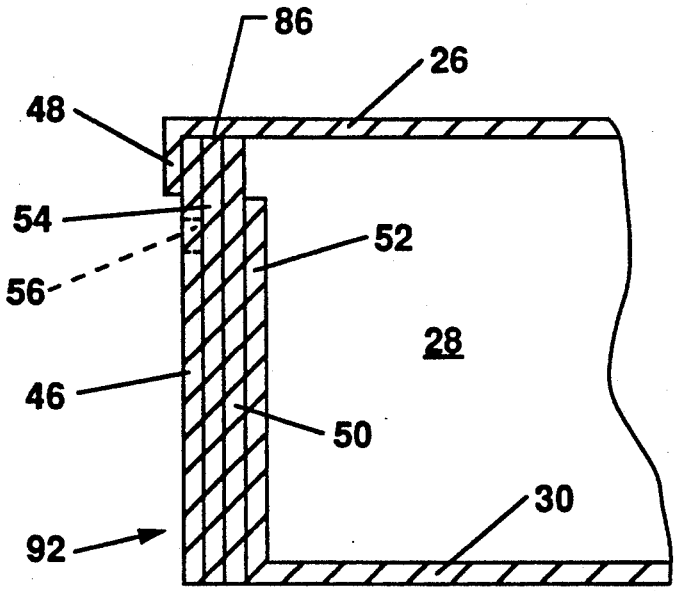
FIG. 8 is a fragmentary cross-sectional view taken along line 8—8 of FIG. 1 showing the end wall construction of the carton of FIG. 1.

When used by the product packager, the sleeve is set up, one end is folded and sealed, the carton 20 is filled, and then the other end is folded and sealed. As seen in FIG. 6, to set up the carton 20 the sleeve is squared so that each of the five main panels 24, 26, 28, 30 and 32 are at substantially right angles to their adjacent panels. To fold and seal one end, the minor flap 52 associated with the bottom panel 30 is first folded 90° about the axial score line 42 to a position perpendicular to the bottom panel 30. The major flap 50 associated with the back panel 28 is folded 90° about the axial score line 42 and preferably adhered to the end flap 52 associated with bottom panel 30. The major flap 54 associated with the front inner panel 32 and the extension panel 46 associated with front outer panel 24, adhered thereto, are then folded 90° about the axial score line 42 and adhered to the exterior side of the major flap 50 of the back panel 28. Lastly, the ear 48 associated with the top wall 26 is folded 90° and adhered to the exterior of the front outer panel 24 extension panel 46. As seen in FIG. 8, the top wall 26 ear 48 is folded over and attached such that the top wall 26 is pulled down against the top edge 86 of the major flaps 50 and 54 creating a barrier to granular movement.

The carton 20 is filled through the remaining open end with a granular material and the other end is folded and sealed. The folding and sealing operation of this end is identical to the folding and sealing operation described above. At this point the carton 20 is filled, sealed and ready for shipment.

Referring to FIG. 1, the carton 20 is an enclosure formed by the various panels and flaps. These panels and flaps are the corresponding walls of the carton 20. The top 26, bottom 30, and back 28 panels are the top 26, bottom 30, and back 28 walls, respectively. The front wall 90 is made up of the front inner panel 32 and the front outer panel 24. The end walls 92 are made from the remaining flaps, panels and ears. The top wall 26 opposes the bottom wall 30, the front wall 32 opposes the back wall 28 and the end walls 92 oppose each other.

Figure 7:
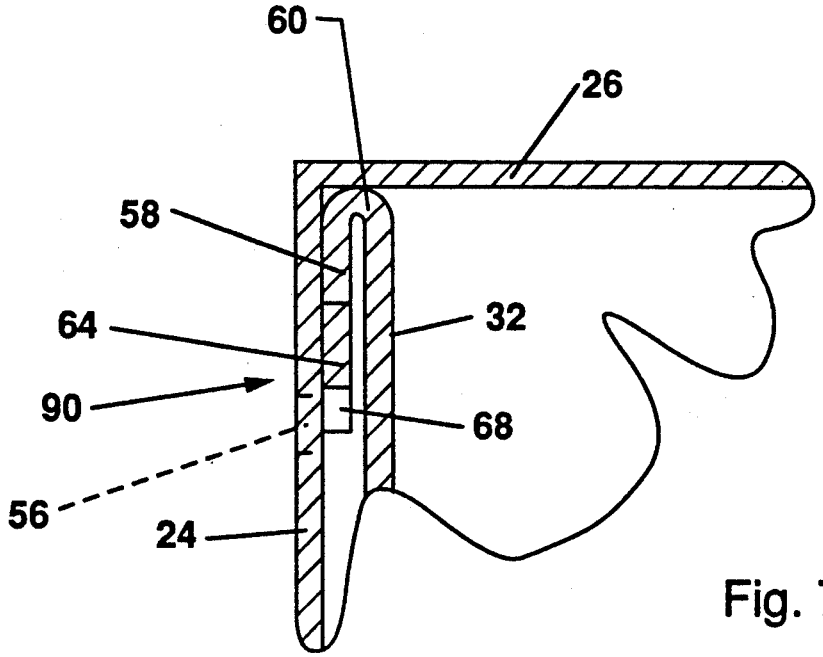
FIG. 7 is a cross-sectional view taken along line 7—7 of FIG. 6 showing the wall construction of the sleeve.

The walls of the carton 20 as assembled are seen in FIGS. 7 and 8. Referring to FIG. 8, each end wall 92 includes a total of five layers. The innermost layer is the minor flap 52 associated with the bottom wall 30. The second layer is the major flap 50 associated with the back wall 28. The middle and fourth layers are the major flap 54 associated with the front inner panel 32 and the extension panel 46 of the front outer panel 24, respectively. The outermost layer is the ear 48 associated with the top wall 26. As seen in the drawing, the top wall 26 is pulled tightly against the top edge 86 of the major flaps 50 and 54. This provides a sift-proof barrier which prevents granules from migrating during shipment to the space between the major flap 54 associated with the front inner panel 32 and extension panel 46 of the front outer panel 24. If granules migrate to this area spillage will result upon opening of the carton 20. In addition to providing a sift-proof barrier, the major end flaps 50 and 54, being coextensive, i.e., having substantially the same dimensions as the end wall 92, provide added strength to the carton 20.

Referring to FIG. 7, the front wall 90 is formed of three layers. The layers of the front wall 90 are formed from the front inner panel 32, front outer panel 24, and glue flap 59, which comprises proximal locking portion 58, distal attachment portion 64, and opening tab 68. Front inner panel 32 and front outer panel 24 are attached to each other below the tear strip 56. Distal attachment portion 64 is attached to front outer panel 24 above the tear strip 56. Proximal locking portion 58 and distal attachment portion 64 provide reinforcement for front inner panel 32. This reinforcement of front inner panel 32 prevents migration of granules over front inner panel 32 during shipping as the front inner panel 32 is less likely to be deformed due to the pressure applied by the granular contents within the carton. In addition, the cut score line 60 being a partial cut instead of a complete cut prevents the migration of granules through the cut in the area between the front inner panel 32 and the front outer panel 24. The cut score line 60 must be deep enough to facilitate bending of the proximal locking portion 58 during repeated opening and closing of the carton 20, but it must not be so deep as to permit the proximal locking portion 58 to be detached from the front inner panel 32.

To open the carton 20 the user grasps the tab of the tear strip 56 and pulls the tear strip 56 away from the carton 20. Removal of the tear strip 56 exposes opening tab 68 to the user. The user grasps opening tab 68 and pulls the opening tab 68 upward. This separates the top, which includes the front outer panel 24 and associated panel extensions 46 and 47 above the tear strip 56, the top wall 26, the ears 48 and 49 and the distal attachment portion 64, from the remainder of the carton 20. The top is a three-sided lid which is now free to rotate. As the lid is rotated about the transverse score line 36, which joins the top wall 26 to the back wall 28, the proximal locking portion 58 of glue flap 59 is separated from the distal attachment portion 64. Rotating the lid along this score line 36 to an open position allows access the contents of the carton 20. As the lid is rotated proximal locking portion 58 is pulled in an upward direction about cut score line 60. This elevation of proximal locking portion 58 returns the granular contents that may have migrated between the proximal locking portion 58 and the front outer panel 24 back into the carton where they can be properly dispensed with little or no mess. After dispensing the desired amount of granular products, the carton 20 may be closed by rotating the lid back to the closed position. As the lid is rotated back to the closed position tabs 62 and 63 of proximal locking portion 58 engage cutouts 66 and 67 of distal attachment portion 64. When completely closed, the proximal locking portion 58 and distal attachment portion 64 together hold the lid in closed condition until it is forcibly lifted. The disengaging and engaging of proximal locking portion 58 with distal attachment portion 64 via opening and closing of the carton lid can be repeated until the contents of the carton 20 have been emptied.

Figure 9:
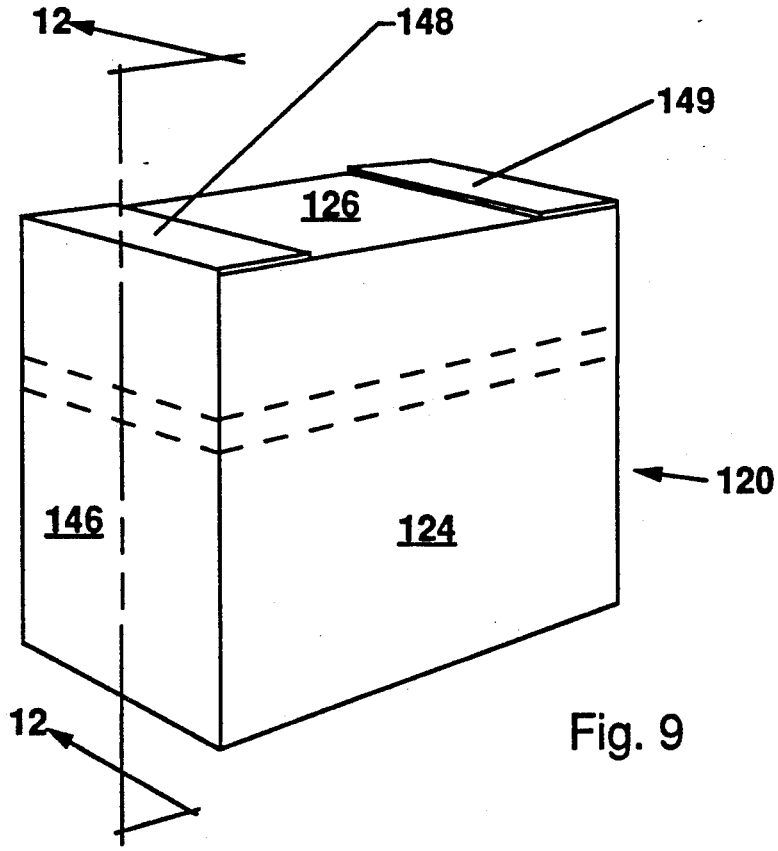
FIG. 9 is a perspective view of a second preferred embodiment of the present invention, prior to opening.
Figure 10:
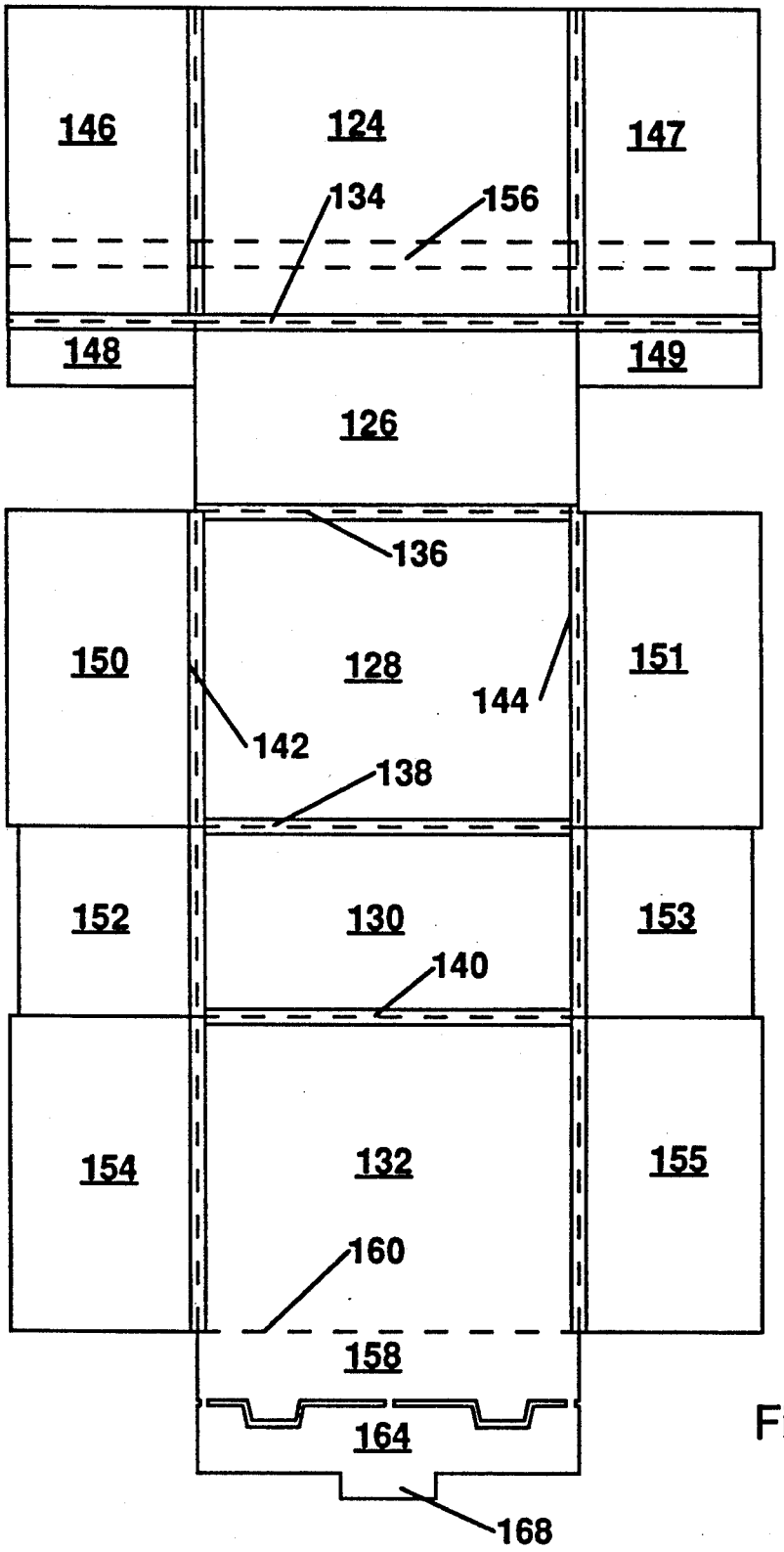
FIG. 10 is a top plan view of the blank used to make the carton of FIG. 9.

A second preferred embodiment can be seen in FIG. 9. This second embodiment is made from the blank of FIG. 10. The blank of FIG. 10 is virtually identical to the blank of FIG. 3. The only difference is that the ears 148 and 149 extend from the extension panels 146 and 147 of front outer panel 124 along transverse score line 134 rather than from the top panel 126. The top panel 126 has no end flaps attached to its axial edges. As seen in FIG. 9, this blank results in a carton 120 having the ears 148 and 149 attached to the top wall 126.

Figure 11:
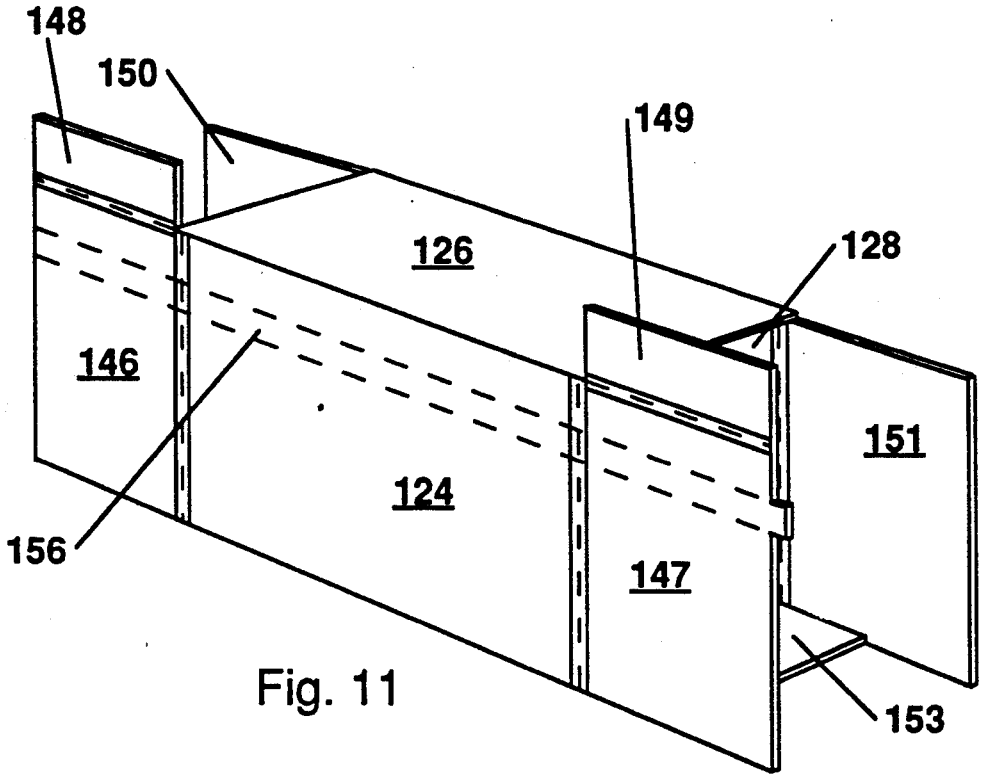
FIG. 11 is a perspective view of a sleeve formed from the blank of FIG. 10 after being squared for transformation into the carton of FIG. 9.

This blank is folded and glued into the sleeve configuration for shipment to the product packager as the previous embodiment. Upon receipt by the packager the carton 120 is squared as seen in FIG. 11. Folding and sealing the ends requires a slightly different operation, however, than the previous embodiment. As described before, the bottom panel 130 minor flap 152, the back panel 128 major flap 150, and then the front inner panel 132 major flap 154 and the front outer panel 124 extension panel 146 are sequentially folded 90° and glued to the adjacent flaps. Then the ear 148, which is connected to the extension panel 146 of front outer panel 124, is folded about the score line 134 and glued to the top wall 126. This last step is done such that the top panel 126 is pressed tightly against the top edge 186 of the major flaps 150 and 154 creating a sift proof barrier. The same operation is followed to seal the other end of the carton 120.

Figure 12:
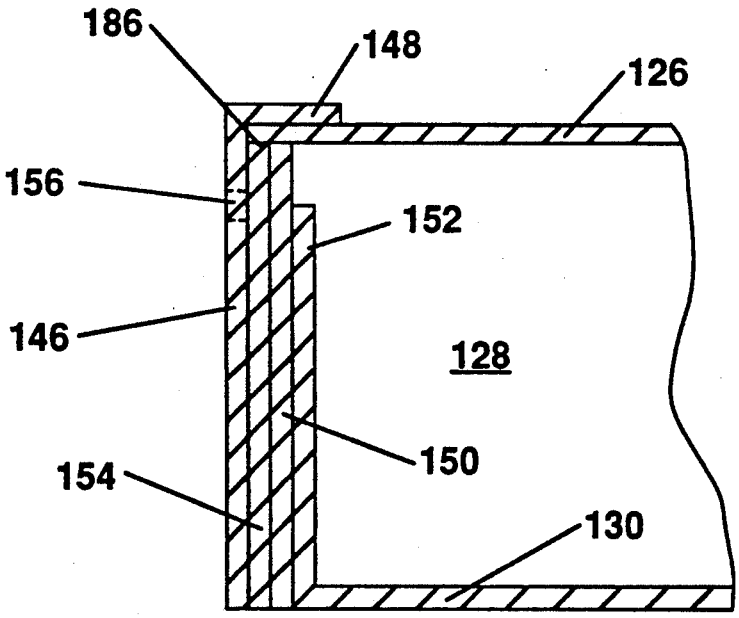
FIG. 12 is a fragmentary cross-sectional view taken along line 12—12 of FIG. 9 showing the end wall construction of the preferred embodiment.

Referring to FIG. 12, the carton 120 of FIG. 9 is shown in cross section. Each end wall consists of four layers. The innermost layer is the bottom panel 130 minor flap 152. The next layers are the back wall 128 major flap 150 followed by the major flap 154 of front outer panel 132 . The outer most layer is the extension panel 146 associated with front outer panel 124. The top wall 126 has the ear 148 attached thereto. The ear 148 is connected along the score line 134 to the tear strip extension panel 146.

Figure 13:
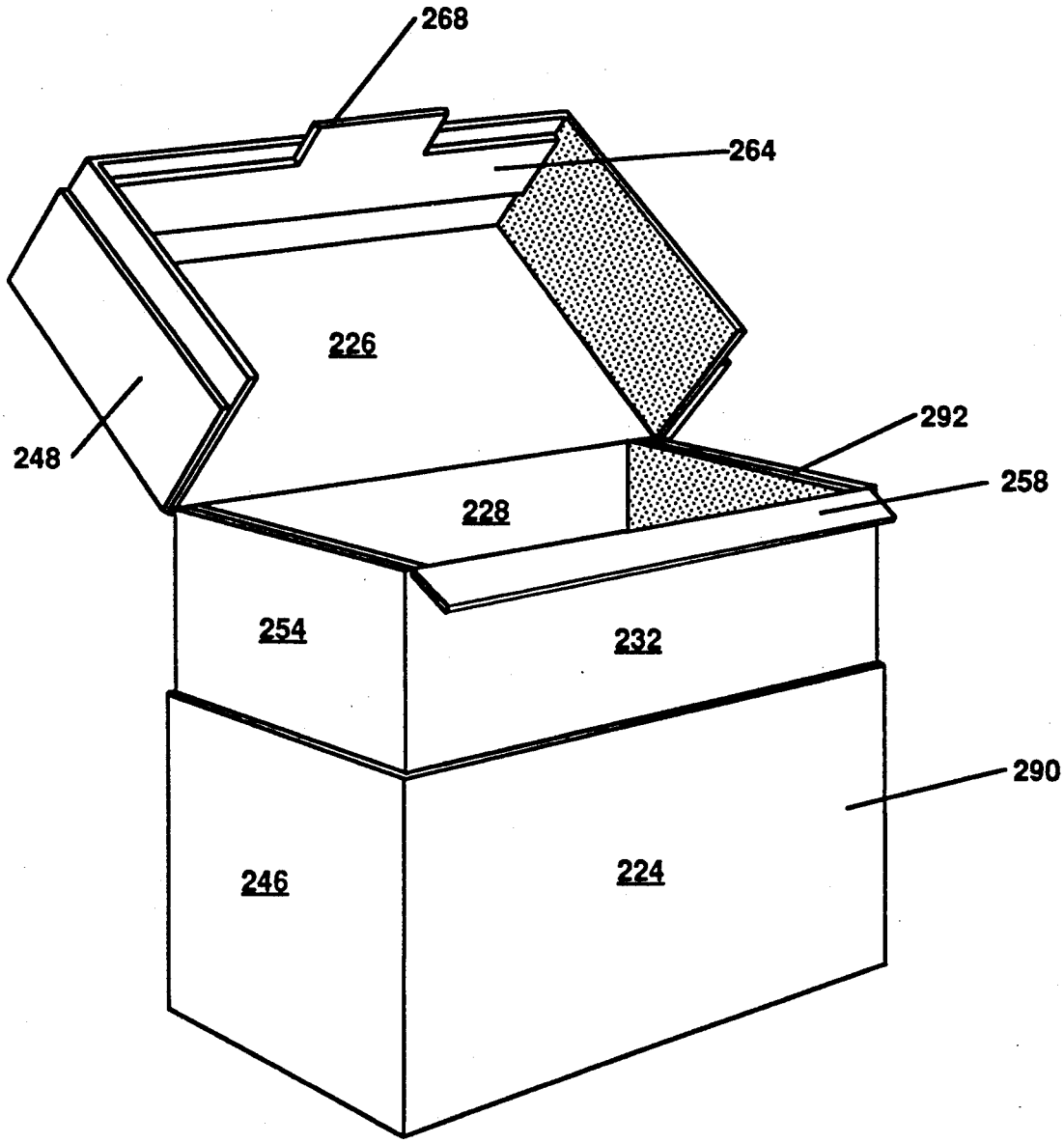
FIG. 13 is a perspective view of a third preferred embodiment of the present invention, seen in an open condition with the top raised.

A third preferred embodiment can be seen in FIG. 13. The carton of FIG. 13 is virtually identical to the cartons of FIGS. 1 and 9 and their respective blanks shown in FIGS. 3 and 10. The only difference is that proximal locking portion 258 and corresponding distal attachment portion 264 of glue flap 59 contain no tabs and corresponding cutouts.

Figure 14:
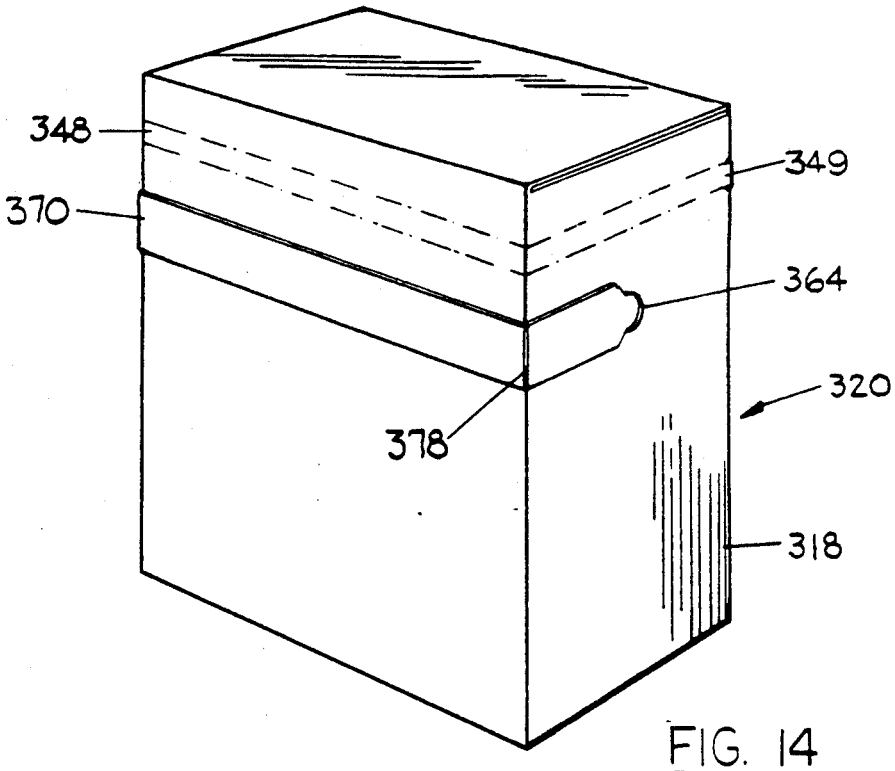
FIG. 14 is a perspective view of a fourth preferred embodiment of the present invention, with the handle in the shipping position.

A fourth preferred embodiment, shown in FIG. 14, provides a carton indicated generally as 320, with a handle 370, the carton being adapted for housing granular or powdered materials. The embodiment shown in FIG. 14, is similar to the carton disclosed in commonly assigned U.S. Pat. No. 4,986,420 issued to Gunn et al. on Jan. 22, 1991, the description of the general structure of such carton being hereby incorporated by reference herein.

Figure 15:
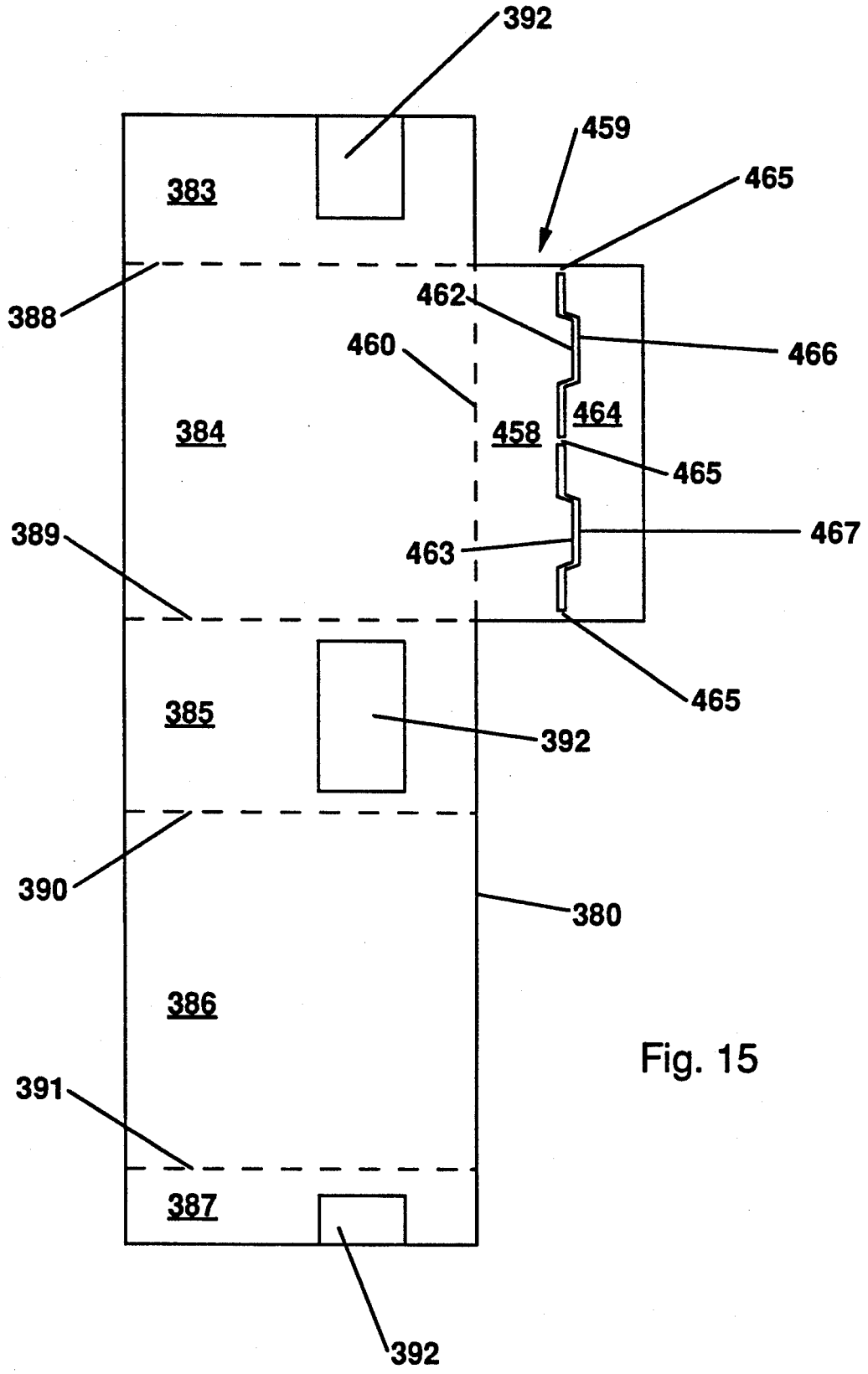
FIG. 15 is a top plan view of the blank of the liner used in the carton of FIG. 14.

Referring to FIG. 15 there is shown the blank for the improved paperboard liner 380 of this embodiment. It has five segments 383, 384, 385, 386 and 387 separated by four axial score lines 388, 389, 390 and 391, which can be perforated lines. Embossed areas 392 are preferably located on the liner 380 (although it may be in the outer carton body as well) such that when the carton 320 is assembled, filled and sealed, they will create a thin cavity between the liner 380 and the outer body 318 adjacent the area immediately surrounding the apertures 364 in the outer body 318.

A glue flap 459 comprising proximal locking portion 458 and distal attachment portion 464 is connected to segment 384 via cut score line 460. The cut score line 460 is preferably cut deeply enough to facilitate bending of the proximal locking portion 458 about cut score line 460 but not so deep as to permit the proximal locking portion 458 to separate from segment 384 during repeated normal opening of the carton 320. Cut score line 460, being a partial cut instead of a full cut, prevents the granular material from migrating through the cut.

Proximal locking portion 458 is connected to distal attachment portion 464 along a full length line of weakness which comprises remotely spaced land areas 465. A pair of tabs 462 and 463 are located along the full length line of weakness opposite a pair of matching cutouts 466 and 467. The engagement between tabs 462 and 463 and cutouts 466 and 467 in use permits the carton 320 to be repeatedly opened and locked down, as will be discussed hereinafter.

Figure 16:
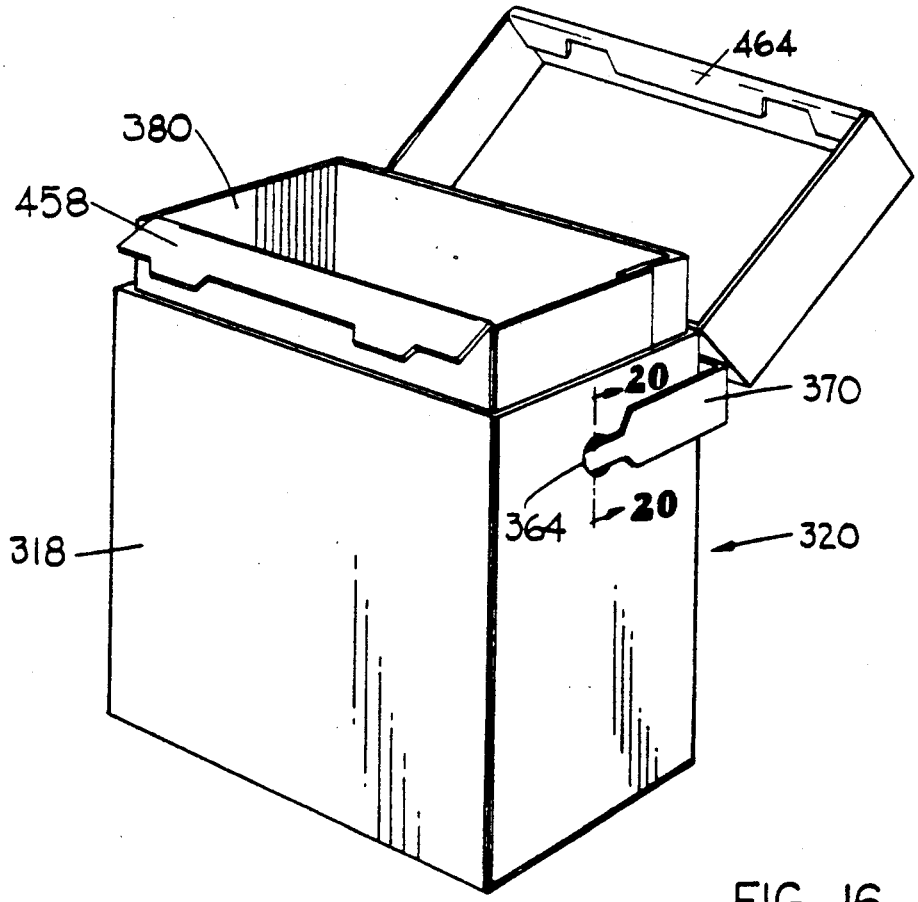
FIG. 16 is a perspective view of the embodiment of FIG. 14, seen in an open condition with the top raised and with the handle out of the way.

Referring to FIG. 14, the result is an assembled carton 320 filled with granular material. The carton 320 has a top wall, a bottom wall, a front wall, a back wall and a pair of opposing end walls. Referring to FIG. 16, the front, back and end walls consists of an inner and outer layer. The inner layer comprises liner 380 and the outer layer comprises outer body 318. Proximal locking portion 458 and distal attachment portion 464 of glue flap 459 provide reinforcement for the front inner layer. This reinforcement of the front inner layer prevents migration of granules over the front inner layer during shipping as the front inner layer is less likely to be deformed due to the pressure applied by the granular contents within the carton. Each end wall has an aperture 364 therein. The liner 380 serves to prevent the flow of the granular contents out through the apertures 364. The liner 380 is located adjacent the apertures 364, separating the contents of the carton 320 from the area immediately surrounding the apertures 364.

To open the carton 320 the user rotates the handle 370 down toward either the front or the back of the carton 320 and grasps tab 349 of the tear strip 348 and removes the tear strip 348, seen in FIG. 14. The user rotates the lid which is connected to the back wall by a hinge line to the open position, seen in FIG. 16. As the lid is rotated about the hinge, the proximal locking portion 458 is separated from the distal attachment portion 464 and proximal locking portion 458 is pulled in an upward direction about cut score line 460. The elevation of proximal locking portion 458 returns the granular contents that may have migrated between the proximal locking portion 458 and the outer body 318 back into the carton where they can be properly dispensed. After dispensing the desired amount of granular product, the carton 320 may be closed by rotating the lid back to the closed position about the hinge. As the lid is rotated back to the closed position tabs 462 and 463 engage cutouts 466 and 467. When completely closed, the proximal locking portion 458 and distal attachment portion 464 together hold the lid in closed condition until it is forcibly lifted. The disengaging and engaging of proximal locking portion 458 with distal attachment portion 464 via opening and closing of the carton lid can be repeated until the contents of the carton 320 have been emptied.

Although particular embodiments of the present invention have been shown and described, modification may be made to the carton without departing from the teachings of the present invention. The terms used in describing the invention are used in their descriptive sense and not as terms of limitation, it being intended that all equivalents thereof be included within the scope of the appended claims.

What is claimed is:

1. A side-fill, sift-resistant, reclosable carton for granular or powdered materials and having opposed top and bottom walls, opposing front and back walls, and opposing end walls, wherein:

(a) each of the end walls comprises front and back closure flaps constituting two main layers attached to each other in face-to-face relation and having a top edge coterminus with the top wall, a bottom closure flap which constitutes a third layer is attached in face-to-face relation to the main layers, and an extension panel from the front wall provides a fourth layer which has a horizontal tear strip thereacross, the fourth layer being attached to the exterior of the other layers below the tear strip;

(b) the front wall comprises an inner layer having a top edge abutting the top wall and an outer layer, the outer layer having a horizontal tear strip thereacross which is integral with the tear strips of the end walls, forming one continuous tear strip, the inner and outer layers being attached to each other below the tear strip;

(c) an ear is attached to each of the end walls above the tear strip, the ear being integrally attached to the top wall, and holding the top wall against the top edge of the main layers; and (d) a glue flap integrally attached to the top edge of the inner layer of the front wall along substantially its full length, the glue flap comprising a distal attachment portion and a proximal locking portion, the two portions being joined along a full length line of weakness, said distal attachment portion being secured to the inner surface of the outer layer of the front wall above the tear strip.

2. A side-fill, sift-resistant, reclosable carton according to claim 1 wherein the proximal locking portion of the glue flap comprises one or more tabs along the full length line of weakness.

3. A side-fill, sift-resistant, reclosable carton according to claim 1 wherein the main layers of each end wall are coextensive with the end wall.

4. A side-fill, sift-resistant, reclosable carton according to claim 1 wherein each ear is integrally attached to the fourth layer of the end wall.

5. A side-fill, sift-resistant, reclosable carton according to claim 1 wherein the front inner panel is coextensive with the front outer panel.

6. A blank for forming a side-fill, sift-resistant, reclosable carton comprising:

(a) a front outer panel having an extension panel being attached along axial score lines to each axial edge of the front outer panel, the front outer panel and extension panels having a transverse tear strip therein;

(b) a top panel being attached along its upper transverse edge to the lower transverse edge of the front outer panel;

(c) a back panel being attached along its upper transverse edge to the lower transverse edge of the top panel, the back panel having a major flap having a transverse dimension substantially equivalent to the axial dimension of the top panel attached along axial score lines to each axial edge of the back panel;

(d) a bottom panel being attached along its upper transverse edge to the lower transverse edge of the back panel, the bottom panel having a minor flap attached along axial score lines to each axial edge of the bottom panel;

(e) a front inner panel being attached along its upper transverse edge to the lower transverse edge of the bottom panel, the front inner panel having a major flap having a transverse dimension substantially equivalent to the axial dimension of the top panel attached along axial score lines to each axial edge of the front inner panel;

(f) an ear being attached along a score line to one of each axial edge of the top panel or each lower transverse edge of the front outer extension panels;

(g) a glue flap being integrally attached along its upper transverse edge to the lower transverse edge of the front inner panel along a full length score line, the glue flap comprising a distal attachment portion and a proximal locking portion, the two portions being joined along a full length line of weakness.

7. A blank according to claim 6 wherein the major and minor flaps have substantially the same transverse dimensions.

8. A blank according to claim 6 wherein the glue flap comprises one or more tabs along the proximal locking portion of the full length line of weakness.

* * * * *

UNITED STATES PATENT AND TRADEMARK OFFICE

CERTIFICATE OF CORRECTION

PATENT NO. : 5,161,734

DATED : November 10, 1992

INVENTOR(S) : DENNIS J. RUEHL ET AL.

It is certified that error appears in the above-identified patent and that said Letters Patent is hereby corrected as shown below:

In the DESCRIPTION OF THE PREFERRED EMBODIMENT, column 3, line 36, "5 47" should read -- 47 --.

In the DESCRIPTION OF THE PREFERRED EMBODIMENT, column 4, line 8, "180" should read -- 180° --.

Signed and Sealed this

Fifth Day of October, 1993

*Attest:*

Bruce Lehman

BRUCE LEHMAN

*Attesting Officer*

*Commissioner of Patents and Trademarks*